United States Patent [19]

Landis, Jr. et al.

[11] 4,193,738

[45] Mar. 18, 1980

[54] FLOATING SEAL FOR A VARIABLE AREA TURBINE NOZZLE

[75] Inventors: Delmer H. Landis, Jr.; Theodore T. Thomas, Jr., both of Loveland; Charles J. Haap, Cincinnati, all of Ohio

[73] Assignee: General Electric Company, Cincinnati, Ohio

[21] Appl. No.: 834,626

[22] Filed: Sep. 19, 1977

[51] Int. Cl.[2] ..... F01D 9/02; F16J 15/16

[52] U.S. Cl. ..... 415/115; 415/117; 415/160; 415/208; 415/217; 277/27

[58] Field of Search ..... 415/156, 159, 160, 162, 415/163, 164, 208, 217, 216, 115, 116, 117; 277/27, 96, 96.1

[56] References Cited

U.S. PATENT DOCUMENTS

| | | | |
|---|---|---|---|
| 3,101,926 | 8/1963 | Weber | 415/163 X |
| 3,117,716 | 1/1964 | Wernicke | 415/173 R X |
| 3,601,497 | 8/1971 | Mayo | 415/163 |

*Primary Examiner*—Louis J. Casaregola
*Assistant Examiner*—Donald S. Holland
*Attorney, Agent, or Firm*—Robert C. Lampe, Jr.; Derek P. Lawrence

[57] ABSTRACT

An improved floating seal is provided to minimize leakage around the ends of a variable area turbine stator nozzle for use in cooperation with a circumscribing shroud. The seal is contoured to float within a pocket formed in the end of the nozzle vane which extends to the vane trailing edge. The forward end of the seal is forced into engagement with the shroud by the pressure of cooling air from within the vane. A seal surface attached to the trailing edge of the seal and projecting laterally of the vane utilizes the differential pressure across the vane airfoil surfaces to hold the trailing edge of the seal into engagement with the shroud. The improved floating seal reduces vane end leakage experienced by prior art floating seals.

5 Claims, 6 Drawing Figures

P
2
6

FLOATING SEAL FOR A VARIABLE AREA TURBINE NOZZLE

BACKGROUND OF THE INVENTION

This invention relates generally to nozzle vanes for use in gas turbine engines and, more particularly, to improved sealing means therefor.

It is well understood that the performance of a gas turbine engine turbine can be enhanced by incorporating a variable area turbine nozzle, a stage of variable position vanes which controls the flow of hot combustion gases into the downstream rotating turbine rotor blade row. Such turbine nozzle variability is necessary in advanced variable cycle engines in order to obtain variable cycle characteristics since the propulsive cycle balances out differently as the turbine nozzle area is changed. One characteristic of nozzle vanes which presents a difficulty is that they are disposed in proximity with circumscribing shrouds. However, since the variable area nozzle vane must be able to rotate open and closed to regulate nozzle area, it cannot be rigidly attached to these shrouds. As a result, one of the major concerns in the design of such variable area turbine nozzles is what is commonly referred to as "end wall leakage" or the flow of turbomachinery operating fluid from the vane airfoil pressure surface to the suction surface through the gap between the end of the nozzle vane and its associated proximate shroud. Since turbine efficiency decreases with increasing vane end clearance, it is desirable to minimize the clearance to maximize efficiency. However, some gap is required to preclude undesirable frictional contact between the vane end and shroud because the plane of rotation of the moving vane is not exactly true. Also, large swings in temperature of the operating fluid entering the turbine cause variations in clearance which must be accounted for. These problems have long been recognized and many types of floating seals have been proposed to minimize this end wall leakage. However, in most of these designs the nozzle sidewalls combine to form an open end or cavity in the vane in which the seal floats, urged into promixity with the circumscribing shroud by gas pressure being provided from within the vane. As a result of the vane cavity being enclosed by the sidewalls, a portion of the trailing edge remains unsealed, allowing operating fluid to leak across that portion of the vane end and adversely affecting turbine nozzle efficiency. Furthermore, in most designs, even if the seal and its associated cavity were to extend to the vane trailing edge, the usual source of high pressure internal vane cooling air could not be utilized to hold the seal trailing edge into contact with the shroud since this pressurized air could not be routed to that portion due to the thinness of vane trailing edge. It becomes desirable, therefore, to have a floating vane end seal which extends entirely to the vane trailing edge and which may be urged into contact with the proximate shroud along its entire length to minimize end wall leakage.

SUMMARY OF THE INVENTION

Accordingly, it is the primary object of the present invention to provide an improved nozzle vane seal to minimize end wall leakage.

It is another object of the present invention to provide an improved seal which extends to the vane trailing edge.

These and other objects and advantages will be more clearly understood from the following detailed description, drawing and specific examples, all of which are intended to be typical of rather than in any way limiting to the scope of the present invention.

Briefly stated, the above objectives are accomplished by providing an improved floating seal within a contoured pocket at the end of a variable area turbine stator nozzle. The floating seal is urged into engagement with the proximate shroud by pressure from two sources. The forward end of the seal is urged outwardly by the pressure of cooling air from within the vane which flows into the contoured cavity through a plurality of apertures and which displaces the seal much in the manner of a piston. A seal surface attached to the trailing edge of the seal and projecting laterally of the vane utilizes the differential pressure across the vane airfoil surfaces to hold the trailing edge of the seal into engagement with the shroud. This surface provides a pressure force against the seal in an area of the vane otherwise inaccessible to internal coolant pressure forces and permits the seal to extend entirely to the vane trailing edge, thereby reducing vane end leakage and enhancing overall turbine nozzle performance.

DESCRIPTION OF THE DRAWING

While the specification concludes with claims particularly pointing out and distinctly claiming the subject matter which is regarded as part of the present invention, it is believed that the invention will be more fully understood from the following description of the preferred embodiment which is given by way of example with the accompanying drawing in which:

DESCRIPTION OF THE PREFERRED EMBODIMENT

Figures 1, 2, 3, 4, 5, 6:
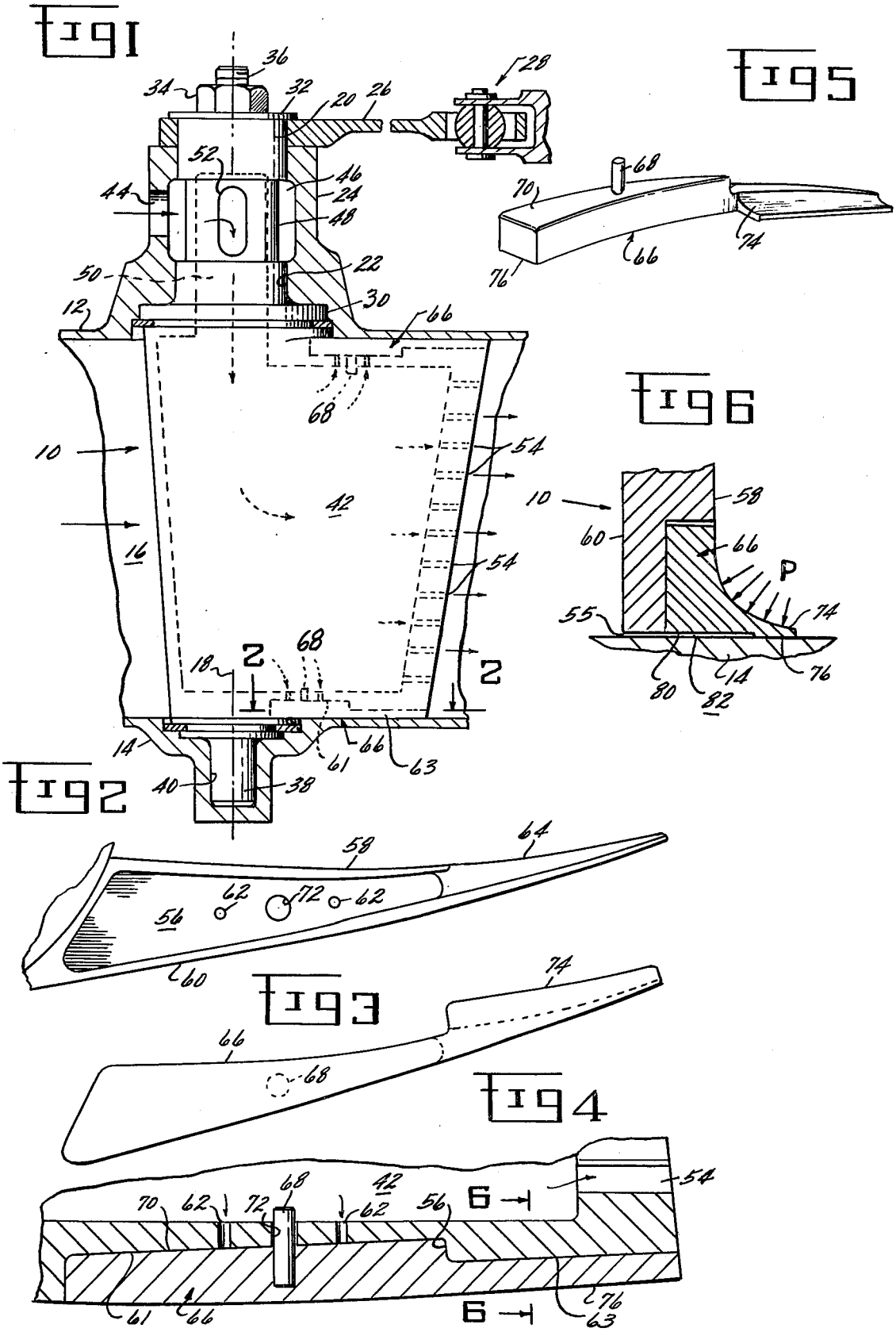
FIG. 1 is a view in partial cross section of a gas turbine nozzle vane constructed in accordance with the present invention and showing its relationship within the turbine hot gas flow path.
FIG. 2 is an enlarged view taken along line 2—2 of FIG. 1 illustrating, in particular, the contoured seal cavity.
FIG. 3 is a plan form sketch of the seal of the present invention which is adapted to be received within the contoured cavity illustrated in FIG. 2.
FIG. 4 is an enlarged cross-sectional view of the end portion of the vane of FIG. 1 illustrating the installation of the seal of FIG. 3 in the cavity of FIG. 2.
FIG. 5 is a perspective view of an uninstalled seal fabricated in accordance with the present invention.
FIG. 6 is a cross-sectional view taken along line 6—6 of FIG. 4 schematically illustrating the pressure forces acting upon the improved seal of the present invention.

Referring to the drawing wherein like numerals correspond to like elements throughout, attention is first directed to FIG. 1 which discloses a view in cross section of a gas turbine engine nozzle vane, generally designated 10, supported between two flow path defining walls, or shrouds, 12 and 14 defining therebetween a hot gas flow path 16. It is to be understood that flow path 16 is annular in shape and receives a cascade of circumferentially equispaced vanes 10, only one of which is shown herein for clarity. In order to assure relatively constant turbine efficiency over a range of engine operating conditions and to provide variable cycle capability to the turbomachinery of which nozzle vane 10 is a part, vane 10 is of the variable area variety pivotable about an axis 18. The vane is supported from outer flow path wall 12 by means of a generally cylindrical trunnion 20 of stepped diameter which is received within a cooperating bore 22 formed within a boss 24 projecting radially from flow path wall 12. A lever arm 26 engages that portion of trunnion 20 which extends beyond boss 24 in order to impart rotation to the vane. The lever arms from each vane are connected to a unison ring assembly 28 for simultaneous actuation of the cascade of vanes 10 in a manner well known in the art. The actuator arm 26 and boss 24 are captured between collar 30 associated with trunnion 20 and washer 32, and secured by nut 34 on threaded shaft portion 36 of trunnion 20. The opposite end of the vane is provided with a similar trunnion 38 of stepped diameter journaled within a complementary bore 40 within the inner flow path wall 14.

Modern aircraft gas turbine engines operate at turbine nozzle inlet air temperature levels which are beyond the structural temperature capabilities of high temperature alloys. Hence, these nozzle vanes must be cooled in order to assure their structural integrity in order to meet operating life requirements. Accordingly, nozzle vane 10 is provided with a generally hollow interior 42 which receives a supply of coolant air from an external coolant source (not shown) but which is typically air bled from the discharge of a gas turbine engine compressor. Since vane 10 is of the fluid-cooled variety, means are required to route the cooling air from its source to the hollow vane interior 42. Thus, a passage 44 is formed within boss 24 to carry cooling air from its source, as indicated by the arrow, into an enlarged cavity 46 therein. The trunnion 20 is hollow, having a reduced diameter portion 48 with a bore passage 50 formed therein. Communication between passage 50 and passage 44 is provided by means of at least one aperture 52. Cooling air thus flows through passage 44 and aperture 52 into bore passage 50 and thereafter into hollow vane interior 42. The internal cooling of the vane may be affected in any of a number of well-known techniques incorporating, either singly or in combination, the principles of convection or impingement cooling with at least a portion of the cooling air exiting the vane in the downstream direction through a plurality of slots 54 at the vane trailing edge.

Sealing the gap 55 (FIG. 6) between the ends of vane 10 and walls 12 and 14 is accomplished by means of seals which comprise the subject matter of the present invention. Since the method of sealing is substantially the same on both ends of the vane, attention will be directed with particular reference to the sealing of the vane end proximate flow path defining wall 14 and it will be recognized that similar seals can be utilized on the opposite vane end.

As is best depicted in FIGS. 1, 2, 4 and 5, the vane end is provided with a stepped cavity generally contoured to follow the profile of the vane pressure and suction surfaces 58 and 60, respectively. The deep portion 61 of the cavity communicates with the pressurized hollow vane interior 42 via a plurality of holes 62, only two of which are shown. In the more rearward, shallow portion 63 of the cavity where the vane thickness becomes quite small and where it would be impractical to provide holes to communicate with the vane interior, the vane pressure surface is relieved at 64 and the cavity, but for the existence of a seal soon to be described, is in fluid communication with the turbine operating fluid.

A floating seal 66, generally contoured to the profile of cavity 56, is slidingly received therein and maintained in proper alignment to prevent binding by means of a pin 68 projecting from the bottom surface 70 of the seal. This pin 68 is slidingly received within a cooperating hole 72 in the vane at the base of cavity 56. Means communicating between the hollow vane interior and the cavity, such as holes 62, directs the pressurized coolant air into impingement with seal 66 to urge the seal into engagement with the adjacent flow path defining wall 14. However, since holes 62 cannot extend all of the way to the vane trailing edge due to limitations on vane trailing edge thickness, means must be provided to augment the piston-like action provided by holes 62 in order to urge the aft end of seal 66 into engagement with the wall.

To this end, and in accordance with the present invention, the seal is provided with a seal surface 74 which projects laterally from the seal from the side thereof associated with the vane pressure surface. This seal surface is so contoured that when the seal is inserted within its cavity 56, the seal surface projects through the vane pressure surface 58 at 64 and into the hot turbine operating fluid stream. As is well understood by those familiar with fluid dynamics, the static pressure of the hot gas flow stream along the blade pressure surface 58 (the concave surface) exceeds that along the suction surface 60 (the convex surface) due to the inherent camber in the vane. The present invention takes advantage of this pressure differential in that the wing provides a surface upon which the higher static pressure P associated with the vane pressure surface can act (see arrows in FIG. 6). Furthermore, the seal face 76 which contacts wall 14 is relieved at 80 to form a passage 82 which is in fluid communication with the operating fluid acting upon the vane suction surface through gap 55. This gap 55 is a means for providing fluid communication between the underside of the seal surface and the suction side of the vane. Thus, passage 82 is at substantially the relatively lower static pressure level associated with the suction surface at the vane tip and the seal experiences substantially the entire pressure differential across the vane tip to create a force for urging the seal surface 74 (and therefore the aft end of seal 66) into contact with wall 14. Complementary forces, therefore, urge the floating seal outwardly along its entire length to minimize end wall losses, the flow of turbine operating fluid across the vane tip between the vane and the wall. The internal coolant fluid impinging against the seal urges the forward seal portion outwardly whereas the higher static pressures associated with the vane pressure surface create a force upon the seal surface 74 urging the aft seal portion outwardly. In practice it will be recognized that the seal face 76 adjacent the wall must be further contoured to conform to the wall profile so as to minimize gaps as the vane is pivoted open and closed.

It should be obvious to one skilled in the art that certain changes can be made to the above-described invention without departing from the broad, inventive concepts thereof. For example, the improved seals of the present invention are not limited in application to the turbine nozzle vanes of aircraft gas turbine engines in particular, but are applicable to any variable area turbomachinery vane, whether it be part of a compressor or turbine. Furthermore, the profile of the seal and its receiving slot may be altered somewhat while still retaining the novel seal surface to urge the seal outwardly into proximity with a nearby wall or shroud. In fact, in some applications the seal relief at 80 may be eliminated if the pressure surface static pressure is sufficiently high. It is intended that the appended claims cover these and all other variations in the present invention's broader inventive concepts.

Having thus described the invention, what is considered novel and desired to be secured by Letters Patent of the United States is:

1. In a seal for disposition within a contoured cavity formed within a turbomachinery vane end to reduce fluid leakage between the vane end and an associated flow path defining wall, wherein the vane has a pressure surface and a suction surface, the improvement comprising a seal surface formed upon the seal and extending laterally beyond the vane pressure surface, and means for providing fluid communication between the underside of the seal surface and the suction side of the vane.

2. A turbomachinery vane having a tip, a pressure surface, a suction surface, a leading edge and a trailing edge for use in cooperation with a proximate fluid flow path defining wall comprising a seal for disposition within a cavity formed within the tip proximate the wall wherein the cavity forms an opening through the vane pressure surface and wherein said seal is generally contoured to the cavity and includes a seal surface which extends laterally beyond the vane through the cavity opening in the vane pressure surface, and means for providing fluid communication between the underside of the seal surface and the suction side of the vane.

3. The vane as recited in claim 2 wherein said cavity and said seal extend to the vane trailing edge.

4. The vane as recited in claim 2 wherein the seal is relieved along a portion of its surface adjacent the wall to form a passage in fluid communication with the vane suction surface across the tip.

5. A turbomachinery vane having a tip, a pressure surface, a suction surface, a leading edge and a trailing edge for use in cooperation with a proximate flow path defining wall and having cooling air circulating through the interior thereof comprising:

a seal for disposition within a cavity formed within the tip proximate the wall wherein the cavity extends to the vane trailing edge and forms an opening through the vane pressure surface;

means communicating between the hollow vane interior and the cavity for directing a flow of air into the cavity, thereby urging the seal outwardly into contact with the wall; and a seal surface comprising a portion of the seal extending laterally beyond the vane through the cavity opening in the vane pressure surface, and means for exposing said seal surface to the pressure of the turbine operating fluid to create a force thereon to further urge the seal outwardly into contact with the wall.

* * * * *